US010040107B2

(12) United States Patent
Sano

(10) Patent No.: US 10,040,107 B2
(45) Date of Patent: Aug. 7, 2018

(54) TEMPERATURE CONTROL APPARATUS OF HOT-ROLLING MILL

(71) Applicant: TOSHIBA MITSUBISHI-ELECTRIC INDUSTRIAL SYSTEMS CORPORATION, Chuo-ku (JP)

(72) Inventor: Mitsuhiko Sano, Tokyo (JP)

(73) Assignee: TOSHIBA MITSUBISHI-ELECTRIC INDUSTRIAL SYSTEMS CORPORATION, Chuo-ku (JP)

( * ) Notice: Subject to any disclaimer, the term of this patent is extended or adjusted under 35 U.S.C. 154(b) by 204 days.

(21) Appl. No.: 15/111,700

(22) PCT Filed: Feb. 4, 2014

(86) PCT No.: PCT/JP2014/052539
§ 371 (c)(1),
(2) Date: Jul. 14, 2016

(87) PCT Pub. No.: WO2015/118606
PCT Pub. Date: Aug. 13, 2015

(65) Prior Publication Data

US 2016/0339494 A1 Nov. 24, 2016

(51) Int. Cl.
*B21B 37/74* (2006.01)
*B21B 45/00* (2006.01)
*B21B 45/02* (2006.01)

(52) U.S. Cl.
CPC ..... *B21B 37/74* (2013.01); *B21B 45/004* (2013.01); *B21B 45/0203* (2013.01)

(58) Field of Classification Search
CPC ..... B21B 37/47; B21B 37/74; B21B 38/006; B21B 45/004
See application file for complete search history.

(56) References Cited

U.S. PATENT DOCUMENTS 5,787,746 A * 8/1998 Ferreira ..... B21B 37/52 72/11.3
6,220,067 B1 4/2001 Sano
2015/0352612 A1* 12/2015 Jinnai ..... B21B 37/00 700/150

FOREIGN PATENT DOCUMENTS

JP 61-29110 B2 7/1986
JP 63-171215 A 7/1988
(Continued)

OTHER PUBLICATIONS

International Search Report dated May 13, 2014, in PCT/JP2014/052539 filed Feb. 4, 2014.

*Primary Examiner* — Debra Sullivan
(74) *Attorney, Agent, or Firm* — Oblon, McClelland, Maier & Neustadt, L.L.P.

(57) ABSTRACT

A temperature control apparatus of a hot-rolling mill according to the present invention extracts a high-frequency component, a medium-frequency component, and a low-frequency component from a deviation between a calculated value or a measured value of a material temperature in a temperature managing position set on an outlet side of the hot-rolling mill and a given temperature target value. The temperature control apparatus then corrects a reference value of electric power of an induction heating device set to an electric power changing device based on the high-frequency component, corrects a reference value of a cooling water flow rate set to a flow rate changing device based on the medium-frequency component, and corrects a reference value of a roll rotation speed set to a speed changing device based on the low-frequency component.

2 Claims, 2 Drawing Sheets

(56) References Cited

FOREIGN PATENT DOCUMENTS

| | | | |
|---|---|---|---|
| JP | 3-99710 | A | 4/1991 |
| JP | 9-141316 | A | 6/1997 |
| JP | 10-314820 | A | 12/1998 |
| JP | 11-342410 | A | 12/1999 |
| JP | 3041134 | B2 | 5/2000 |
| JP | 2000-210708 | A | 8/2000 |
| JP | 2003-33808 | A | 2/2003 |
| JP | 3657750 | B2 | 6/2005 |
| JP | 2007-75850 | A | 3/2007 |
| WO | WO 2010/058457 | A1 | 5/2010 |

* cited by examiner

TEMPERATURE CONTROL APPARATUS OF HOT-ROLLING MILL

TECHNICAL FIELD

The present invention relates to a temperature control apparatus of a hot-rolling mill and, more specifically, to a temperature control apparatus that operates temperature adjusting means so that a material temperature in a temperature managing position set on an outlet side of a rolling mill becomes a target value.

BACKGROUND ART

In hot rolling, it is requested to obtain desired material characteristics of a product, such as tensile strength, and to keep surface quality of the product excellent. In order to respond to these requests, a temperature managing position is set on an outlet side of a rolling mill, and temperature control is performed for making a material temperature at the temperature managing position coincide with a designated target value over an entire length of a material.

As means for adjusting the material temperature in hot rolling, next three ones have been known. Conventionally, various temperature control methods using the three temperature adjusting means have been proposed.

First temperature adjusting means: Changing rolling speed

Second temperature adjusting means: Changing cooling water flow rate of cooling device Third temperature adjusting means: Changing electric power of induction heating device For example, a temperature control method utilizing the first and the second temperature adjusting means is shown in Patent Literature 1. According to the method disclosed in Patent Literature 1, a cooling water flow rate to be needed is calculated using a temperature model regarding a number of calculation points of a material in a longitudinal direction, and the cooling water flow rate is operated by feedforward control. In addition, the cooling water flow rate is operated by feedback control so that a deviation between a material temperature and a target value in a temperature managing position is reduced. Further, when the cooling water flow rate reaches an upper limit or a lower limit, a rolling speed is corrected by the feedback control so that the material temperature becomes the target value.

In addition, a temperature control method utilizing the third temperature adjusting means is shown in Patent Literature 2. In raising a temperature of a material in a heating furnace, when the material comes into contact with a water-cooled support beam in the furnace, a skid mark due to decrease in temperature is generated at a portion of the material having come into contact with the support beam. According to the method disclosed in Patent Literature 2, fluctuations in temperature in a temperature managing position is suppressed by increasing electric power of induction heating locally with respect to the skid mark.

CITATION LIST

Patent Literature

Patent Literature 1:
Japanese Patent No. 3657750
Patent Literature 2:
Japanese Patent Publication No. 61-29110

Patent Literature 3:
Japanese Patent Laid-Open No. 3-99710
Patent Literature 4:
Japanese Patent No. 3041134
Patent Literature 5:
International Publication No. WO 10/058457

SUMMARY OF INVENTION

Technical Problem

By the way, the above-described first to third temperature adjusting means differ in response characteristics concerning temperature adjustment. However, the response characteristics described here are those also including operational various constraints, and do not necessarily coincide with response characteristics in a single device. It is referred to as having a fast response that rapid change can be made under the operational various constraints, and having a slow response that change is limited to a slow one.

As for the first temperature adjusting means, rapid change of the rolling speed causes a control disturbance of a whole line. For this reason, change of the rolling speed for temperature adjustment is limited to slow one. That is, the first temperature adjusting means has a slow response concerning the temperature adjustment. Note that the control disturbance includes that tension between stands fluctuates to cause deterioration of plate width accuracy, a cooling time of water cooling in a downstream cooling installation (a run out table) changes to cause fluctuations in temperature of a coiler inlet side, etc.

Meanwhile, change of electric power of the induction heating device has a good response since it is performed by an electric circuit, and rapid change can be made. That is, the third temperature adjusting means has a fast response concerning the temperature adjustment.

As for the second temperature adjusting means, in a case where a servo valve having a good response, etc. are applied to the cooling device, intermediate characteristics of the first and the third temperature adjusting means can be obtained in both of changeability and a change range. Consequently, when response characteristics of the three temperature adjusting means are compared with each other, it can be said that the third temperature adjusting means, the second temperature adjusting means, and the first temperature adjusting means have faster responses concerning temperature adjustment in that order.

However, a difference in the response characteristics among the first to third temperature adjusting means as described above has not been sufficiently taken into consideration in a conventional temperature control method. That is, the conventional temperature control method is merely a combination of the first to third temperature adjusting means, and thus, it has a limit in improving temperature accuracy.

Specifically, even though the first temperature adjusting means having a slow response is applied to a short-time phenomenon as the skid mark, temperature fluctuations of the material cannot be sufficiently removed. Meanwhile, there is a difference between a tip and a tail end of the material in standby time on an inlet side of a rolling mill train. For this reason, a temperature difference (thermal rundown) in a longitudinal direction may reach tens of degrees due to the difference in standby time. If large temperature fluctuations over a long time as described above are all tried to be removed only by the third temperature adjusting means, an electric power value of the induction heating device easily reaches an upper limit or a lower limit, and thereby a material temperature target value cannot be maintained in some cases. In addition, as is disclosed in Patent Literature 1, such a system can also be employed that temperature adjustment is first performed by temperature adjusting means having a good response, and that the temperature adjustment is switched to the one by next temperature adjusting means if an operational amount of the temperature adjusting means approaches an upper limit or a lower limit. However, the system has a problem of delay in switching.

The present invention has been made in view of the aforementioned problems, and an object thereof is to improve temperature accuracy of a rolled material by properly operating each temperature adjusting means according to response characteristics thereof in a hot-rolling mill that has a plurality of the temperature adjusting means having different response characteristics.

Solution to Problem

In order to achieve the above-described object, a temperature control apparatus of a hot-rolling mill according to the present invention is configured as follows.

The temperature control apparatus of the hot-rolling mill according to the present invention is applied to a hot-rolling mill including: a rolling stand that rolls a rolled material; a water cooling device that cools the rolled material; an induction heating device that heats the rolled material; a speed changing device that changes a roll rotation speed of the rolling stand; a flow rate changing device that changes a cooling water flow rate of the water cooling device; and an electric power changing device that changes electric power of the induction heating device.

According to one embodiment of the present invention, the temperature control apparatus applied to the hot-rolling mill includes: a setup calculating device; an outlet-side temperature calculating device; a frequency component extracting device; an electric power setting correcting device; a flow rate setting correcting device; and a speed setting correcting device. The setup calculating device is configured to calculate an initial value of each of a reference value of electric power with respect to the electric power changing device, a reference value of a cooling water flow rate with respect to the flow rate changing device, and a reference value of a roll rotation speed with respect to the speed changing device, based on given manufacturing instruction information. The outlet-side temperature calculating device is configured to calculate temperatures of a plurality of calculation points of the rolled material in a longitudinal direction at time points when the calculation points arrive at a temperature managing position set on an outlet side of the hot-rolling mill, based on a measured temperature or a calculated temperature of each calculation point at an inlet side of the hot-rolling mill, the roll rotation speed of the rolling stand, the electric power of the induction heating device, and the cooling water flow rate of the water cooling device. The frequency component extracting device is configured to extract a high-frequency component, a medium-frequency component, and a low-frequency component from a deviation between an outlet-side temperature of each calculation point calculated by the outlet-side temperature calculating device and a given temperature target value. The electric power setting correcting device is configured to correct the reference value of the electric power with respect to the electric power changing device based on the high-frequency component. The flow rate setting correcting device is configured to correct the reference value of the cooling water flow rate with respect to the flow rate changing device based on the medium-frequency component. Additionally, the speed setting correcting device is configured to correct the reference value of the roll rotation speed with respect to the speed changing device based on the low-frequency component.

According to another embodiment of the present invention, the temperature control apparatus applied to the hot-rolling mill includes: a setup calculating device; a thermometer; a frequency component extracting device; an electric power setting correcting device; a flow rate setting correcting device; and a speed setting correcting device. The setup calculating device is configured to calculate an initial value of each of a reference value of electric power with respect to the electric power changing device, a reference value of a cooling water flow rate with respect to the flow rate changing device, and a reference value of a roll rotation speed with respect to the speed changing device, based on given manufacturing instruction information. The thermometer is configured to measure a temperature of the rolled material at the outlet side of the hot-rolling mill. The frequency component extracting device is configured to extract a high-frequency component, a medium-frequency component, and a low-frequency component from a deviation between the temperature of the rolled material measured by the thermometer and a given temperature target value. The electric power setting correcting device is configured to correct the reference value of the electric power with respect to the electric power changing device based on the high-frequency component. The flow rate setting correcting device is configured to correct the reference value of the cooling water flow rate with respect to the flow rate changing device based on the medium-frequency component. Additionally, the speed setting correcting device is configured to correct the reference value of the roll rotation speed with respect to the speed changing device based on the low-frequency component.

Advantageous Effects of Invention

According to the present invention, the component that fluctuates at a high frequency included in the calculated value or the measured value of the outlet-side temperature of the rolled material can be dealt with by change of the electric power of the induction heating device that is temperature adjusting means having a fast response, the component that fluctuates at a low frequency can be dealt with by change of the roll rotation speed that is temperature adjusting means having a slow response, and the component that fluctuates at a medium frequency can be dealt with by change of the cooling water flow rate that is temperature adjusting means having a medium response. Each temperature adjusting means is operated in consideration of the response characteristics thereof as described above, whereby fluctuations in temperature of the rolled material are promptly suppressed, and an operational amount of each temperature adjusting means becomes hard to reach an upper-limit or a lower limit. Consequently, according to the present invention, temperature accuracy of the rolled material can be improved.

DESCRIPTION OF EMBODIMENTS

First and second embodiments of the present invention will be explained with reference to drawings. In each drawing, the same or similar symbols are given to the same or similar portions. The embodiments shown below exemplify devices and methods for embodying the technical idea of the present invention, and are not intended to limit structures, arrangements, etc. of components to the following ones. The present invention is not limited to the embodiments shown below, and various modifications can be made without departing from the spirit of the present invention.

First Embodiment

A general hot-rolling mill includes one or more rolling stands. A hot-rolling mill according to the embodiment is configured as a finishing mill for hot thin plate rolling (a hot strip mill) of a steel plate including a plurality of rolling stands. There are prepared a heating process and a rough rolling process on an upstream side of the finishing mill, a rolled material (hereinafter simply referred to as a material) with a plate thickness of approximately 200 to 250 mm heated to approximately 1200° C. is rolled until the plate thickness becomes approximately 20 to 50 mm, and subsequently, it is conveyed to the finishing mill by an electric conveying table. In addition, there are arranged a cooling table (a run out table) including a number of cooling water nozzles, and a winding machine (a coiler) on a downstream side of the finishing mill, and the rolled material is wound in a coil shape after being cooled.

Figure 1:
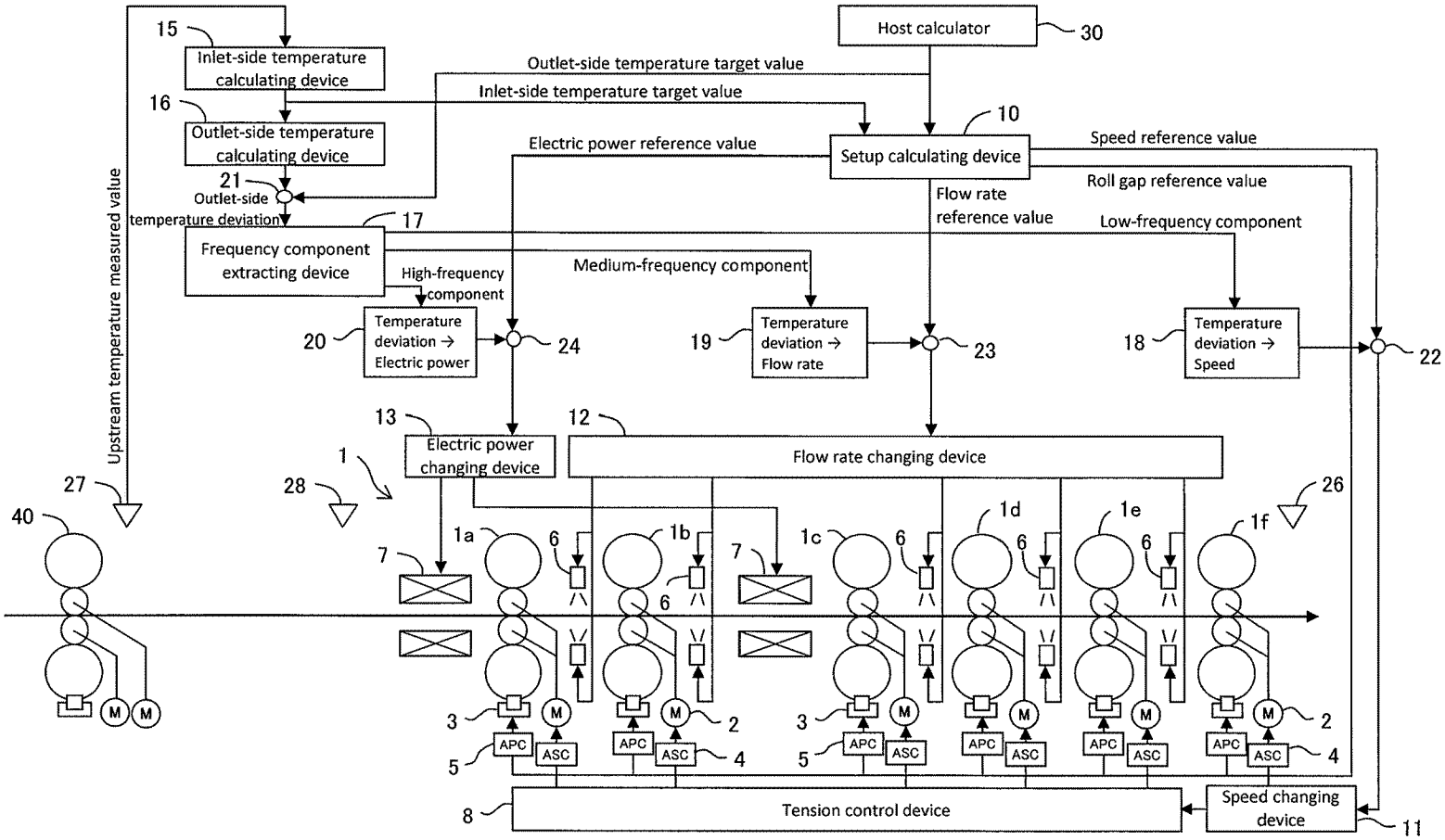
FIG. 1 is a schematic diagram showing a configuration of a hot-rolling mill and a temperature control apparatus thereof according to a first embodiment of the present invention.

As shown in FIG. 1, a finishing mill 1 includes six rolling stands 1*a* to 1*f* in the embodiment. A motor 2 that rotates a roll is included in each of the rolling stands 1*a* to 1*f*. Operation of the motor 2 is performed by a constant speed control device (ASC) 4 provided for each motor 2. In addition, a hydraulic or an electric screw-down device 3 for changing a roll gap is included in each of the rolling stands 1*a* to 1*f*. Operation of the screw-down device 3 is performed by a fixed position control device (APC) 5 provided at the screw-down device 3. Each of the constant speed control device 4 and the fixed position control device 5 operates in accordance with a reference value calculated by a setup calculating device 10.

When the material rolled in the rough rolling process arrives at a predetermined position in front of the finishing mill 1, the setup calculating device 10 calculates an outlet-side plate thickness and a roll gap reference value of each of the rolling stands 1*a* to 1*f* so that a product having a desired plate thickness designated from a host calculator 30 can be manufactured. Since details of this technique are, for example, well-known as disclosed in Patent Literature 3, explanation thereof is omitted here. The fixed position control device 5 operates the screw-down device 3 in accordance with the roll gap reference value calculated by the setup calculating device 10.

The setup calculating device 10 also decides a motor rotation speed of the last rolling stand 1*f* by an after-mentioned method. Further, the setup calculating device 10 calculates a roll rotation speed of each of the rolling stands 1*a* to 1*e* so that a volume speed (a mass flow) of the material at an outlet side of the other each of the rolling stands 1*a* to 1*e* becomes constant in order to stably thread the material. The reference value of the roll rotation speed calculated by the setup calculating device 10 is input to a speed changing device 11. The constant speed control device 4 operates the motor 2 in accordance with a motor rotation speed on which the speed changing device 11 instructs. Note that during the rolling, a tension control device 8 instructs the constant speed control device 4 on a motor rotation speed. The tension control device 8 adjusts the roll rotation speed of each of the rolling stands 1*a* to 1*e* through the constant speed control device 4 so that tension acting on the material becomes proper one. Since details of this technique are, for example, well-known as disclosed in Patent Literature 4, explanation thereof is omitted here. In addition, the setup calculating device 10 tracks a position of the material on a line using a not-shown hot piece detector (HMD) installed at an important place on the line, and a speed actual value of the conveying table.

A water cooling device 6 for cooling the material rolled at the rolling stands 1*a* to 1*e* is installed among the rolling stands 1*a* to 1*f*. The water cooling device 6 is arranged at an upper side and a lower side of a conveying line, respectively so as to be able to cool the material from both an upper surface and a lower surface of the material. The water cooling device 6 has a flow rate adjusting valve, and can adjust a flow rate of cooling water to be poured by operating an opening degree of the valve. Change of the cooling water flow rate of each water cooling device 6 is made by a flow rate changing device 12.

An induction heating device 7 for heating the material is installed on an upstream of the leading rolling stand 1*a*, and between the second rolling stand 1*b* and the third rolling stand 1*c*. The induction heating device 7 is arranged at the upper side and the lower side of the conveying line, respectively so as to be able to heat the material from both the upper surface and the lower surface of the material. The induction heating device 7 can adjust heating capability by operating electric power to be supplied. Change of electric power of each induction heating device 7 is made by an electric power changing device 13.

A temperature control apparatus according to the embodiment is applied to the finishing mill 1 having the configuration described above. The temperature control apparatus according to the embodiment includes: an inlet-side temperature calculating device 15; an outlet-side temperature calculating device 16; a frequency component extracting device 17; a speed correction amount calculating device 18; a flow rate correction amount calculating device 19; and an electric power correction amount calculating device 20. The above-mentioned setup calculating device 10 is also one of components included in the temperature control apparatus according to the embodiment.

When the material arrives at the predetermined position in front of the finishing mill 1, the setup calculating device 10 decides an initial value of each of the cooling water flow rate of the water cooling device 6, the electric power of the induction heating device 7, and the roll rotation speed of each of the rolling stands 1*a* to 1*f*, based on manufacturing instruction information given from the host calculator 30. A plate thickness of a product is included in the manufacturing instruction information. Note that the initial value of the cooling water flow rate is a flow rate when a tip of the material arrives at the finishing mill 1, the initial value of the electric power of the induction heating device 7 is electric power when the tip of the material arrives at the finishing mill 1, and that the initial value of the roll rotation speed is a speed when the tip of the material arrives at the finishing mill 1.

Upper and lower limit values by mechanical constraints and operational constraints (for example, constraints for avoiding surface quality deterioration due to generation of oxide scale of steel) are previously designated for the cooling water flow rate, the electric power of the induction heating device 7, and the roll rotation speed. The setup calculating device 10 decides each initial value within a range of the upper and lower limit values. Various methods can be considered to decide the initial value. Here, each initial value of the electric power of the induction heating device 7 having a fast response and the cooling water flow rate of the water cooling device 6 shall be previously decided by indexing a numerical table in a calculator, etc. so that a change range can be sufficiently secured. For example, a median value of the upper and lower limit values may be set to be the initial value. Next, under these conditions, the initial value of the roll rotation speed is calculated so that a temperature of the outlet side of the finishing mill 1 coincides with a target value. However, order of calculation among the initial value is arbitrary. For example, first, the roll rotation speed of the last rolling stand 1*f* and the electric power of the induction heating device 7 are decided by indexing the numerical table in the calculator, etc., and next, under these conditions, the cooling water flow rate of the water cooling device 6 may be calculated so that the temperature of the outlet side of the finishing mill 1 coincides with the target value.

In the calculation of each initial value, the setup calculating device 10 uses a mathematical model that can accurately simulate temperature change while the material passes through the finishing mill 1. Hereinafter, the mathematical model is referred to as a temperature model. The following factors are taken into consideration in the temperature model.

(a) Processing heat generation associated with deformation of material in each rolling stand (b) Frictional heat generation by relative slip of contact surface of material and roll (c) Heat removal from contact surface of material and roll (d) Heat removal from material surface to cooling water (e) Heat input from induction heating device to material surface (f) Heat removal by heat radiation from material surface to atmosphere In calculation of the temperature model, a rolling speed is needed as an input variable. A technique of convergence calculation is used for calculation of the rolling speed. A method disclosed in Patent Literature 5 etc. can be utilized as specific calculation methods of (a) to (e). For example, they can be calculated from the following expressions. Note that all of $q_{pi}$, $q_{fi}$, $q_{Ri}$, $q_{Aj}$, $q_{Wj}$, and $q_{IHj}$ are amounts of heat per unit time and per unit plate width.

<Amount of Processing Heat Generation>

$$q_{pi}=f_p(k_{mi}, V_i, h_{i-1}, h_i) \quad \text{[Expression 1]}$$

<Amount of Frictional Heat Generation>

$$q_{fi}=f_f(\mu, k_{mi}, h_{i-1}, h_i, V_i) \quad \text{[Expression 2]}$$

<Amount of Roll Heat Removal>

$$q_{Ri}=f_R(V_i, T_i, T_{Ri}, h_{i-1}, h_i, \rho, \phi, \lambda, \rho_R, \phi_R, \lambda_R) \quad \text{[Expression 3]}$$

<Amount of Air-Cooling Heat Removal>

$$q_{Aj}=f_A(T_j, T_A, \varepsilon_A, \sigma) \quad \text{[Expression 4]}$$

<Amount of Water-Cooling Heat Removal>

$$q_{Wj}=f_W(T_j, Q_j) \quad \text{[Expression 5]}$$

<Amount of Heat Input from Induction Heating Device>

$$q_{IHj}=f_{IH}(P_{IHj}) \quad \text{[Expression 6]}$$

Here, meanings of signs in the above-described expressions are as follows.

i: Subscript representing number of rolling stand j: Subscripts representing numbers of heating section and cooling section $f_p(\ldots)$: Function representing amount of processing heat generation $f_f(\ldots)$: Function representing amount of frictional heat generation $f_R(\ldots)$: Function representing amount of heat removal to roll $f_A(\ldots)$: Function representing amount of heat removal by air cooling $f_W(\ldots)$: Function representing amount of heat removal by water cooling $f_{IH}(\ldots)$: Function representing amount of heat input from induction heating device $\mu$: Friction coefficient $\rho$: Density of material to be rolled $\phi$: Specific heat of material to be rolled $\lambda$: Heat conductivity of material to be rolled $\rho_R$: Density of roll $\phi_R$: Specific heat of roll $\lambda_R$: Heat conductivity of roll $\varepsilon_A$: Radiation rate to atmosphere $\sigma$: Stefan-Boltzmann constant $Q_i$: Cooling water flow rate $L_{ISi}$: Distance between i stand and (i+1) stand T: Starting temperature of heating section or cooling section $T_A$: Atmospheric temperature $T_{Ri}$: Roll temperature representative value P: Electric power per unit width supplied to induction heating device A number of calculation points are defined on the material in a longitudinal direction of the material at a predetermined interval. Rapid temperature fluctuations, such as a skid mark cannot be captured if the interval of the calculation points is too long, and computing power of the calculator may be insufficient if it is too short to the contrary. Consequently, an interval of approximately 1 to 20 m is desirable at the outlet side of the finishing mill 1. An interval at an inlet side of the finishing mill 1 can be converted by the following expression.

Interval of calculation points of inlet side=Interval of calculation points of outlet side×Plate thickness of inlet side/Plate thickness of outlet side A material temperature (hereinafter described as an upstream temperature) of each calculation point is measured by a radiation thermometer (hereinafter described as an upstream thermometer) 27 installed at a predetermined position of an upstream (for example, an outlet side of a roughing mill 40) of the finishing mill 1. However, the material temperature of each calculation point in the above-described predetermined position may be calculated by the mathematical model based on an operation state of the devices of an upstream side or a measured value of a thermometer in the middle of an upstream process instead of a measured value of the upstream thermometer 27.

The inlet-side temperature calculating device 15 performs the following processing at the timing when the material has arrived at a predetermined inlet-side temperature calculating position 28 between the upstream thermometer 27 and the finishing mill 1. Note that a distance from the upstream thermometer 27 to the inlet-side temperature calculating position 28 is desirably longer than a length of the material. In addition, as for the distance from the inlet-side temperature calculating position 28 to the finishing mill 1, a time required for the material to be conveyed through a section of the distance is desirably longer than any response time of the water cooling device 6, the induction heating device 7, and the speed changing device 11. However, the present invention is not limited to this.

The inlet-side temperature calculating device 15 first calculates a conveying time of each calculation point from a time point of measurement by the upstream thermometer 27 to a time point of arrival at the finishing mill 1. Next, the inlet-side temperature calculating device 15 calculates a material temperature (hereinafter described as an inlet-side temperature) when each calculation point arrives at the inlet side of the finishing mill 1 using an actual value of the upstream temperature and a calculated value of the conveying time. A mathematical model based on balance of heat of the material within the conveying time is used for this calculation. The calculated inlet-side temperature of each calculation point is input to the outlet-side temperature calculating device 16.

The outlet-side temperature calculating device 16 calculates a material temperature (hereinafter described as an outlet-side temperature) when each calculation point arrives at a temperature managing position 26 set on the outlet side of the finishing mill 1 based on the calculated value of the inlet-side temperature, and each reference value or measured value of the cooling water flow rate, the electric power of the induction heating device 7, and the rolling speed. The above-mentioned temperature model is used for this calculation. The setup calculating device 10 calculates initial values of the reference values of the cooling water flow rate etc. from a target value of the outlet-side temperature using the temperature model. In contrast with this, the outlet-side temperature calculating device 16 calculates a predicted value of the outlet-side temperature from an actual cooling water flow rate etc. by performing calculation by the temperature model in a direction opposite to that of the setup calculating device 10. Note that the outlet-side temperature calculating device 16 shares the same temperature model with the setup calculating devices 10. However, the setup calculating device 10 and the outlet-side temperature calculating device 16 may individually include temperature models, respectively. In a case where each of them includes the temperature model, the temperature model may be the one having the same contents, or the temperature model of the setup calculating device 10 may be a detailed one, whereas the temperature model of the outlet-side temperature calculating device 16 may be a simple one, or the reverse may be employed. In addition, the temperature control apparatus of the present invention can also be configured so that the outlet-side temperature calculating device 16 does not include the temperature model, and gets a calculation result by the temperature model from the setup calculating device 10.

A difference (hereinafter described as an outlet-side temperature deviation) between the calculated value of the outlet-side temperature of each calculation point calculated by the outlet-side temperature calculating device 16 and the target value of the outlet-side temperature given from the host calculator 30 is calculated by a computing unit 21. The calculated outlet-side temperature deviation of each calculation point is input to the frequency component extracting device 17.

The frequency component extracting device 17 takes out a high-frequency component, a medium-frequency component, and a low-frequency component from the outlet-side temperature deviation of each calculation point with reference to a time when each calculation point arrives at the inlet side of the finishing mill 1. Each definition of a high frequency, a medium frequency, and a low frequency should be adjusted according to an operation state of a target plant. However, to give examples, the high frequency can be defined to be a frequency component of approximately 1 to 0.1 Hz in consideration of a response of the induction heating device 7, the medium frequency a frequency component of approximately 0.2 to 0.03 Hz in consideration of a response of the water cooling device 6, and the low frequency a frequency component not more than approximately 0.05 Hz.

Various techniques are applicable as an extraction technique of the frequency component. As widely used techniques, there are included (i) a technique for using a digital filter, (ii) a technique by Fourier transform using a window function, and (iii) a technique by wavelet transform.

Various techniques are proposed as the technique of (i). All of them can be utilized for the frequency component extracting device 17. In a simple FIR (Finite Impulse Response) filter, a relation between an input and an output is represented as follows. Here, a low-pass filter (LPF), a high-pass filter (HPF), etc. can be achieved by deciding coefficient arrays $a_0$ to $a_N$ by general-purpose design software. Note that a sign n in Expression 7 indicates a number of a calculation point, a sign N a degree of the filter, a sign x[ ] an input signal, and that a sign y[ ] an output signal.

$$y[n]=a_0 \cdot x[n]+a_1 \cdot x[n-1]+\ldots+a_N \cdot x[n-N] \quad \text{[Expression 7]}$$

When an LPF having a cut-off frequency of approximately 0.02 Hz is applied, a low-frequency component is obtained. When the low-frequency component is then subtracted from an original signal, and subsequently, an LPF having a cut-off frequency of approximately 0.2 Hz is applied, a medium-frequency component is obtained. Further, a HPF of a cut-off frequency of approximately 0.2 Hz is applied, or the low-frequency component and the medium-frequency component are subtracted from the original signal, whereby a high-frequency component is obtained.

In the technique of (ii), the window function is a function that has a value only within a certain finite interval, and becomes zero in the other interval and, for example, a Gaussian window and a Blackman window are known. The Gaussian window is represented by the following expression. Note that t0 is a parameter that represents a time, and that σ is a parameter that represents a window width.

$$w(t) = \exp\left(-\frac{(t-t_0)^2}{\sigma^2}\right) \quad \text{[Expression 8]}$$

When a waveform to be analyzed is multiplied by the window function, and subsequently, Fourier transform is applied, frequency distribution of a specific time can be obtained. Fourier transform is applied while the window function is moved little by little, and thereby a signal for each frequency component can be obtained. Note that a time resolution can be changed by changing the window width of the window function. That is, when the window width is increased too much, it becomes impossible to ignore a time deviation to a short-time phenomenon. Although accuracy of specifying a time can be enhanced if the window width is narrowed, a frequency resolution deteriorates to the contrary, and the frequency cannot be separated into each frequency component. Accordingly, it is suitable for the window width (sigma in the Gaussian window) to be approximately 0.5 to 10 (seconds).

Technique of (iii) has a mechanism in which a wavelet basis function (a mother wavelet) is scaled according to the frequency, specifically, the time resolution becomes high in the high frequency, and has a feature to easily achieve both the time resolution and the frequency resolution. This characteristic changes depending on a used wavelet basis function. Since in a general hot-rolling plant, there are few phenomena in which temperature fluctuations repeatedly occur in a constant short cycle, a low-dimensional function having a good time resolution, i.e., a wavelet basis function having few wave numbers, (for example, a four-dimensional Paul wavelet) is suitable. However, in a case where the temperature repeatedly changes in the constant short cycle for a certain reason, a high-dimensional function having a high frequency resolution, i.e., a wavelet basis function having a number of wave numbers, (for example, a six-dimensional Morlet wavelet) is suitable.

Note that in extraction of the frequency components by the techniques of (ii) and (iii), algorithms have been known in which computation can be efficiently performed in a case where a time increment is performed at equal intervals, and in a case where the number of measurement points is a power of 2. For example, they are a Fast Fourier Transform (FFT), a wavelet transform in a frequency domain, etc. In a case of utilizing these algorithms, data of each calculation point, i.e., an arrival time and an outlet-side temperature deviation are interpolated by linear interpolation, multi-dimensional function interpolation, etc. to thereby restore a waveform, subsequently, resampling is performed at equal time intervals so that the number of data becomes a power of 2 (for example, 1024 points, 2048 points, etc.), and frequency component extraction is applied.

In a manner as described above, a result of having decomposed the outlet-side temperature deviation into each frequency component is obtained at each calculation point in the frequency component extracting device 17. Among the frequency components, a high-frequency component is input to the electric power correction amount calculating device 20, a medium-frequency component to the flow rate correction amount calculating device 19, and a low-frequency component to the speed correction amount calculating device 18.

The electric power correction amount calculating device 20 calculates a correction amount of the electric power of the induction heating device 7 based on the high-frequency component. The same mathematical model as the one used by the setup calculating device 10 for calculation of the initial value of the electric power of the induction heating device 7 can be used for calculation of the electric power correction amount. The electric power correction amount is obtained by back-calculating the mathematical model. However, since a calculation load becomes high by the method, the electric power correction amount is preferably calculated using a simple expression shown below. Note that in the following expression, ΔP indicates an electric power correction amount (kW), $\delta P/\delta T_{FD}$ an influence coefficient (kW/° C.), and that $\Delta T_{FD}^{HF}$ a high-frequency component of an outlet-side temperature deviation.

$$\Delta P = -\frac{\partial P}{\partial T_{FD}} \cdot \Delta T_{FD}^{HF} \quad \text{[Expression 9]}$$

Note that a partial differential coefficient in the above-described expression is previously calculated by a next expression at the time of setup calculation, using a calculation result in a case where a minute value ($\pm\delta_P$) has been added.

$$\frac{\partial P}{\partial T_{FD}} = 1 \Big/ \frac{T_{FD}(P+\delta_P) - T_{FD}(P-\delta_P)}{2 \cdot \delta_P} \quad \text{[Expression 10]}$$

The electric power correction amount calculated by the electric power correction amount calculating device 20 is added to an electric power reference value set by the setup calculating device 10 in a computing unit 24. Hereby, the reference value of the electric power with respect to the electric power changing device 13 is corrected. In the embodiment, an "electric power setting correcting device" is configured by the electric power correction amount calculating device 20 and the computing unit 24. The electric power changing device 13 to which the corrected electric power reference value has been input changes the electric power of the induction heating device 7 in consideration of a time required for the device to change the electric power at the timing when the calculation point has arrived just under the induction heating device 7. In a case where the plurality of induction heating devices 7 are present as in FIG. 1, electric power is changed in accordance with previously designated priority or weight.

The flow rate correction amount calculating device 19 calculates a correction amount of the cooling water flow rate of the water cooling device 6 based on the medium-frequency component. The same mathematical model as the one used by the setup calculating device 10 for calculation of the initial value of the cooling water flow rate of the water cooling device 6 can be used for calculation of the flow rate correction amount. The flow rate correction amount is obtained by back-calculating the mathematical model. However, since a calculation load becomes high by the method, the flow rate correction amount is preferably calculated using a simple expression shown below. Note that in the following expression, Δflw indicates a flow rate correction amount (%), $\delta flw/\delta T_{FD}$ an influence coefficient (%/° C.), and that $\Delta T_{FD}^{MF}$ a medium-frequency component of an outlet-side temperature deviation.

$$\Delta flw = -\frac{\partial flw}{\partial T_{FD}} \cdot \Delta T_{FD}^{MF} \quad \text{[Expression 11]}$$

Note that a partial differential coefficient in the above-described expression is previously calculated by a next expression at the time of setup calculation, using a calculation result in a case where a minute value ($\pm\delta_{flw}$) has been added.

$$\frac{\partial flw}{\partial T_{FD}} = 1 \Big/ \frac{T_{FD}(flw+\delta_{flw}) - T_{FD}(flw-\delta_{flw})}{2 \cdot \delta_{flw}} \quad \text{[Expression 12]}$$

The flow rate correction amount calculated by the flow rate correction amount calculating device 19 is added to a flow rate reference value set by the setup calculating device 10 in a computing unit 23. Hereby, the reference value of a cooling water flow rate with respect to the flow rate changing device 12 is corrected. In the embodiment, a "flow rate setting correcting device" is configured by the flow rate correction amount calculating device 19 and the computing unit 23. The flow rate changing device 12 to which the corrected flow rate reference value has been input changes the cooling water flow rate of the water cooling device 6 in consideration of a time required for the device to change the flow rate at the timing when the calculation point has arrived just under the water cooling device 6. In a case where the plurality of water cooling devices 6 are present as in FIG. 1, electric power is changed in accordance with previously designated priority or weight.

The speed correction amount calculating device 18 calculates a correction amount of the roll rotation speed based on the low-frequency component. The same mathematical model as the one used by the setup calculating device 10 for calculation of the initial value of the roll rotation speed can be used for calculation of a speed correction amount. The speed correction amount is obtained by back-calculating the mathematical model. However, since a calculation load becomes high by the method, the speed correction amount is preferably calculated using a simple expression shown below. Note that in the following expression, $\Delta V$ indicates a speed correction amount (m/s), $\delta V/\delta T_{FD}$ an influence coefficient (m/s/° C.), and that $\Delta T_{FD}^{LF}$ a low-frequency component of an outlet-side temperature deviation.

$$\Delta V = -\frac{\partial V}{\partial T_{FD}} \cdot \Delta T_{FD}^{LF} \qquad \text{[Expression 13]}$$

Note that a partial differential coefficient in the above-described expression is previously calculated by a next expression at the time of setup calculation, using a calculation result in a case where a minute value ($\pm\delta_V$) has been added.

$$\frac{\partial V}{\partial T_{FD}} = 1 \Big/ \frac{T_{FD}(V+\delta_V) - T_{FD}(V-\delta_V)}{2 \cdot \delta_V} \qquad \text{[Expression 14]}$$

The speed correction amount calculated by the speed correction amount calculating device 18 is added to a speed reference value set by the setup calculating device 10 in a computing unit 22. Hereby, the reference value of the roll rotation speed with respect to the speed changing device 11 is corrected. In the embodiment, a "speed setting correcting device" is configured by the speed correction amount calculating device 18 and the computing unit 22. The speed changing device 11 to which the corrected speed reference value has been input changes the roll rotation speed in consideration of a time required for the device to change the speed at the timing when the calculation point has arrived just under the last rolling stand 1*f*.

By the way, since in the embodiment, temperature control of the material is performed by feedforward control using the temperature model, it is unnecessary to install a thermometer at the temperature managing position 26 of the outlet side of the finishing mill 1. However, it is arbitrary to install the thermometer at the temperature managing position 26. In a case where the thermometer is installed, acceptance or rejection of a product can be determined based on temperature data obtained by the thermometer. In addition, an abnormality can be determined from the temperature data, and a parameter of the temperature model can also be learned based on the temperature data.

Second Embodiment

Figure 2:
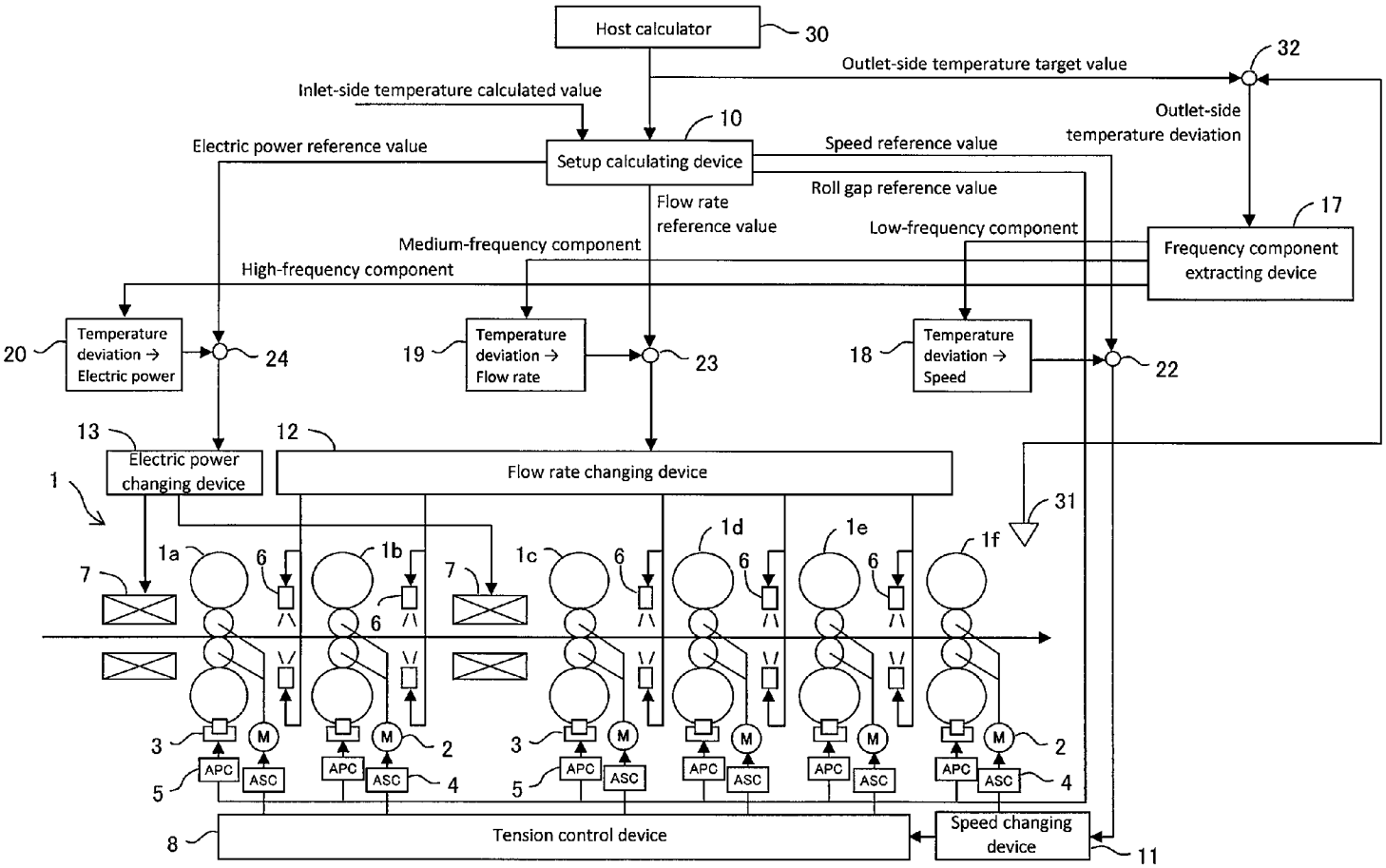
FIG. 2 is a schematic diagram showing a configuration of a hot-rolling mill and a temperature control apparatus thereof according to a second embodiment of the present invention.

A second embodiment of the present invention is shown in FIG. 2. While the outlet-side temperature calculating device 16 calculates the outlet-side temperature using the temperature model in the first embodiment, a radiation thermometer (hereinafter described as an outlet-side thermometer) 31 installed on the outlet side of the finishing mill 1 measures an outlet-side temperature in the embodiment. Additionally, a difference (hereinafter described as an outlet-side temperature deviation) between a measured value of the outlet-side temperature obtained by the outlet-side thermometer 31 and a target value of the outlet-side temperature given from the host calculator 30 is calculated by a computing unit 32. The outlet-side temperature deviation is input to the frequency component extracting device 17 having the same configuration as in the first embodiment. That is, while temperature control of the material is performed by feedforward control in the first embodiment, it is performed by feedback control in the embodiment.

The electric power changing device 13 immediately changes the electric power of the induction heating device 7 based on a high-frequency component extracted by the frequency component extracting device 17. A definition of a high frequency, and a configuration for calculating an electric power correction amount of the induction heating device 7 from the high-frequency component are similar to those of the first embodiment. Note that Smith dead-time compensation may be applied when the electric power is changed. That is, a temperature change amount expected by the change of the electric power may be subtracted from the outlet-side temperature deviation until a point on the material having been present just under the induction heating device 7 at the time point of the change of the electric power is conveyed and arrives just under the outlet-side thermometer 31.

The flow rate changing device 12 changes a flow rate of the water cooling device 6 based on a component of a medium frequency by the frequency component extracting device 17. A definition of the medium frequency, and a configuration for calculating a flow rate change amount of the water cooling device 6 from the medium-frequency component are similar to those of the first embodiment. Note that Smith dead-time compensation may be applied when the flow rate is changed. That is, a temperature change amount expected by the change of the cooling water flow rate may be subtracted from the outlet-side temperature deviation until a point on the material having been present just under the water cooling device 6 at the time point of the change of the flow rate is conveyed and arrives just under the outlet-side thermometer 31.

The speed changing device 11 changes a roll rotation speed of the last rolling stand 1*f* based on a component of a low frequency by the frequency component extracting device 17. A definition of the low frequency, and a configuration for calculating a change amount of a roll rotation speed of the last rolling stand 1*f* from the low-frequency component are similar to those of the first embodiment. Note that Smith dead-time compensation may be applied when the roll rotation speed is changed. That is, a temperature change amount expected by the change of the roll rotation speed may be subtracted from the outlet-side temperature deviation until a point on the material having been present just under the last rolling stand 1*f* at the time point of the change of the roll rotation speed is conveyed and arrives just under the outlet-side thermometer 31.

Note that in a case where Smith dead-time compensation is not applied, or where gain is low even though the Smith dead-time compensation is applied, a response to each change becomes slow due to a dead time corresponding to a distance from the induction heating device 7, the water cooling device 6, or the last rolling stand 1*f*. Consequently, in that case, ranges of the high frequency, the medium frequency, and the low frequency are preferably displaced to a low-frequency side, respectively compared with the first embodiment.

REFERENCE SIGNS LIST

1 finishing mill
1*a* to 1*f* rolling stand
2 motor
3 screw-down device
4 constant speed control device (ASC)
5 fixed position control device (APC)
6 water cooling device
7 induction heating device
8 tension control device
10 setup calculating device
11 speed changing device
12 flow rate changing device
13 electric power changing device
15 inlet-side temperature calculating device
16 outlet-side temperature calculating device
17 frequency component extracting device
18 speed correction amount calculating device
19 flow rate correction amount calculating device
20 electric power correction amount calculating device
26 temperature managing position
27 upstream thermometer
28 inlet-side temperature calculating position
30 host calculator
31 outlet-side thermometer
40 roughing mill

The invention claimed is:

1. A temperature control apparatus of a hot-rolling mill having: a rolling stand that rolls a rolled material; a water cooling device that cools the rolled material; an induction heating device that heats the rolled material; a speed changing device that changes a roll rotation speed of the rolling stand; a flow rate changing device that changes a cooling water flow rate of the water cooling device; and an electric power changing device that changes electric power of the induction heating device, the temperature control apparatus comprising:

a setup calculating device that calculates an initial value of each of a reference value of electric power with respect to the electric power changing device, a reference value of a cooling water flow rate with respect to the flow rate changing device, and a reference value of a roll rotation speed with respect to the speed changing device, based on given manufacturing instruction information;

an outlet-side temperature calculating device that calculates temperatures of a plurality of calculation points of the rolled material in a longitudinal direction at time points when the calculation points arrive at a temperature managing position set on an outlet side of the hot-rolling mill, based on a measured temperature or a calculated temperature of each calculation point at an inlet side of the hot-rolling mill, the roll rotation speed of the rolling stand, the electric power of the induction heating device, and the cooling water flow rate of the water cooling device;

a frequency component extracting device that extracts a high-frequency component, a medium-frequency component, and a low-frequency component from a deviation between the outlet-side temperature of each calculation point calculated by the outlet-side temperature calculating device and a given temperature target value;

an electric power setting correcting device that corrects the reference value of the electric power with respect to the electric power changing device based on the high-frequency component;

a flow rate setting correcting device that corrects the reference value of the cooling water flow rate with respect to the flow rate changing device based on the medium-frequency component; and a speed setting correcting device that corrects the reference value of the roll rotation speed with respect to the speed changing device based on the low-frequency component.

2. A temperature control apparatus of a hot-rolling mill including: a rolling stand that rolls a rolled material; a water cooling device that cools the rolled material; an induction heating device that heats the rolled material; a speed changing device that changes a roll rotation speed of the rolling stand; a flow rate changing device that changes a cooling water flow rate of the water cooling device; and an electric power changing device that changes electric power of the induction heating device, the temperature control apparatus comprising:

a setup calculating device that calculates an initial value of each of a reference value of electric power with respect to the electric power changing device, a reference value of a cooling water flow rate with respect to the flow rate changing device, and a reference value of a roll rotation speed with respect to the speed changing device, based on given manufacturing instruction information;

a thermometer that measures a temperature of the rolled material at an outlet side of the hot-rolling mill;

a frequency component extracting device that extracts a high-frequency component, a medium-frequency component, and a low-frequency component from a deviation between the outlet-side temperature of the rolled material measured by the thermometer and a given temperature target value;

an electric power setting correcting device that corrects the reference value of the electric power with respect to the electric power changing device based on the high-frequency component;

a flow rate setting correcting device that corrects the reference value of the cooling water flow rate with respect to the flow rate changing device based on the medium-frequency component; and a speed setting correcting device that corrects the reference value of the roll rotation speed with respect to the speed changing device based on the low-frequency component.

* * * * *